US006796256B2

(12) United States Patent
Seibert et al.

(10) Patent No.: US 6,796,256 B2
(45) Date of Patent: Sep. 28, 2004

(54) SEWING MACHINE LIGHTING EQUIPMENT

(75) Inventors: Horst Seibert, Bielefeld (DE); Andreas Oberndörfer, Bielefeld (DE); Horst Bohl, Bielefeld (DE); Achim Voss, Spenge (DE)

(73) Assignee: Durkopp Adler Aktiengesellschaft, Bielefeld (DE)

( * ) Notice: Subject to any disclaimer, the term of this patent is extended or adjusted under 35 U.S.C. 154(b) by 0 days.

(21) Appl. No.: 10/397,349

(22) Filed: Mar. 26, 2003

(65) Prior Publication Data

US 2003/0184995 A1 Oct. 2, 2003

(30) Foreign Application Priority Data

Mar. 28, 2002 (DE) ..... 102 13 934

(51) Int. Cl.[7] ..... D05B 23/00
(52) U.S. Cl. ..... 112/270
(58) Field of Search ..... 112/1, 65, 66, 112/68, 258, 259, 217.1, 270; 362/11, 12, 17, 234, 238, 240, 249, 367

(56) References Cited

U.S. PATENT DOCUMENTS

| | | | | | |
|---|---|---|---|---|---|
| 1,955,284 | A | * | 4/1934 | Goosman | 362/90 |
| 4,841,415 | A | * | 6/1989 | Dobner | 362/90 |
| 5,113,324 | A | * | 5/1992 | Dusch | 362/90 |
| 5,215,020 | A | * | 6/1993 | Pordzik | 112/470.03 |
| 6,095,066 | A | | 8/2000 | Nöltge et al. | |

FOREIGN PATENT DOCUMENTS

| | | |
|---|---|---|
| DE | 35 25 698 | 1/1987 |
| DE | 87 03 621.5 | 6/1987 |

OTHER PUBLICATIONS

Patent Abstracts of Japan Publ. No. 2000317187, Nov. 21, 2000, Japan.

* cited by examiner

*Primary Examiner*—Ismael Izaguirre
(74) *Attorney, Agent, or Firm*—McGlew and Tuttle, P.C.

(57) ABSTRACT

A sewing machine lighting equipment comprises light emitting diodes, which are arranged on at least two sides of the needle bar and which are disposed in at least one lighting device.

23 Claims, 3 Drawing Sheets

SEWING MACHINE LIGHTING EQUIPMENT

BACKGROUND OF THE INVENTION

1. Field of the Invention

The invention relates to a lighting equipment on a sewing machine, comprising an arm with a bottom side and with a needle bar; and a work area which is allocated to the needle bar and substantially shadowlessly illuminated.

2. Background Art

In a lighting system known from U.S. Pat. No. 6,168,284 B1, a light is provided on the lower side of the sewing machine arm, illuminating the needle bar and a presser foot rod by a coverage greater than 180°. The light may be a cathode fluorescence lamp. Drawbacks reside in that the glass bulb of the lamp is susceptible to impacts and that lights of this type need a comparatively high operating voltage of 80 V and a high sparking voltage exceeding 300 V. This requires special safety precautions. The current supply equipment is comparatively complicated and costly. The light itself needs a special design, which is accompanied with a high production cost. Obtaining spare parts is complicated. Voltage fluctuations occasion changes in light intensity. Furthermore, a reflector is needed.

DE 87 03 621 U1 describes a lamp, in which the light is led by light guides from a source to the stitch forming area i.e., into the proximity of the needle. Drawbacks reside in the restricted illumination of the stitch forming area, which results in shadows being cast. The light guide itself may interfere with an operator's sewing job. Light intensities fluctuate upon voltage fluctuations. Mounting requirements are considerable, which is also true for the lamp itself.

SUMMARY OF THE INVENTION

It is an object of the invention to develop a lighting equipment of the generic type such that uniform and shadowless illumination of the work area is accompanied with high operational safety, low power consumption, little heat build-up and a low manufacturing cost.

According to the invention, this object is attained by the needle bar being at least bilaterally surrounded by several light emitting diodes which are disposed in at least one lighting device. It is possible to arrange the numerous, approximately spotwise light emitting diodes at the most favorable respective places for optimal shadowless illumination of the work area. Light emitting diodes of this type are characterized by strength and extraordinarily low power consumption i.e., they develop nearly no heat. Several LEDs may be connected in series, with current being fed to any such group of LEDs by their proper stabilized power supply.

Details of the invention will become apparent from the ensuing description of an exemplary embodiment, taken in conjunction with the drawing.

DESCRIPTION OF THE PREFERRED EMBODIMENT

Figure 1:
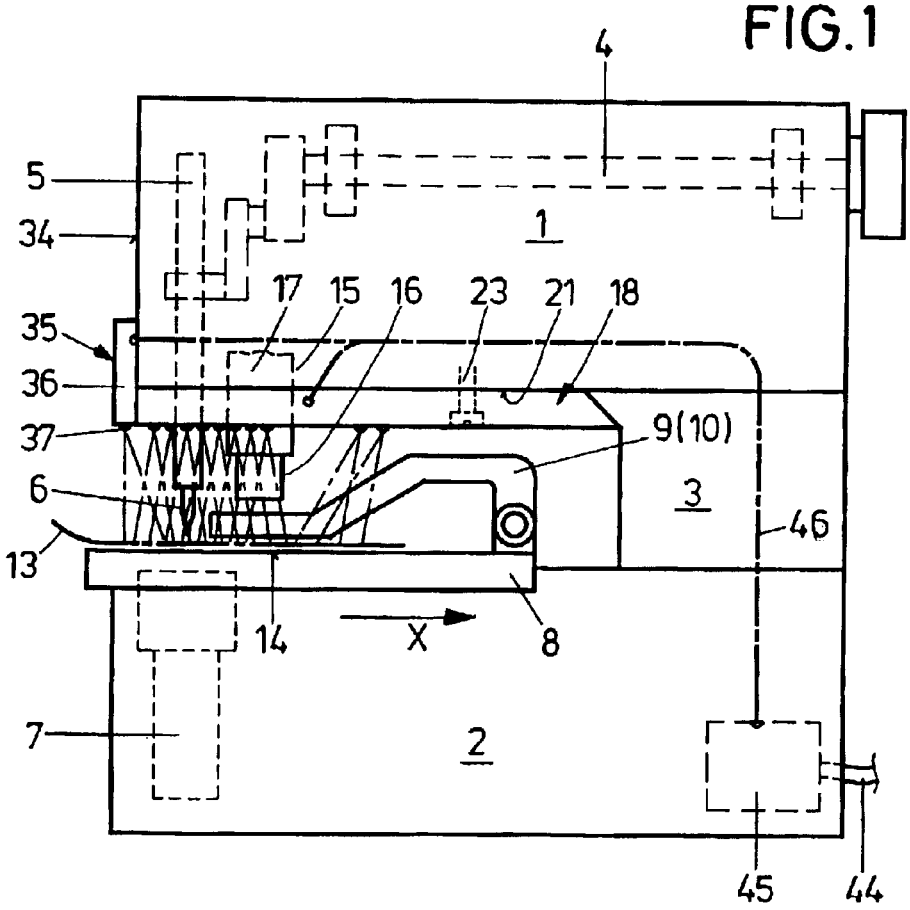
FIG. 1 is a lateral longitudinal view of a buttonhole sewing machine with a lighting equipment according to the invention.
Figure 2:
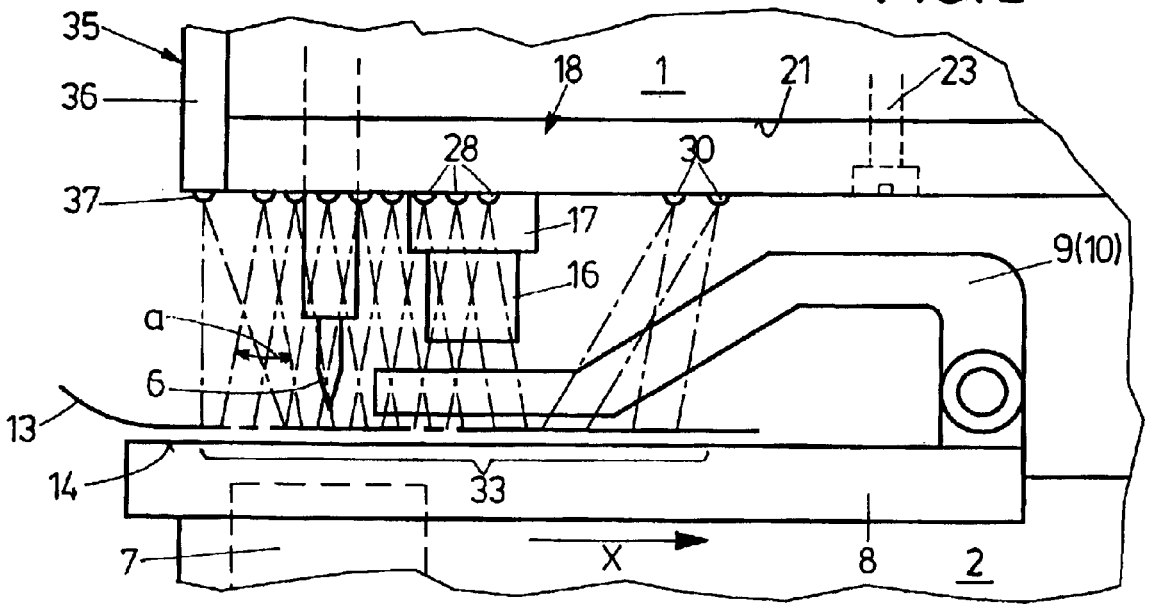
FIG. 2 is a view, on an enlarged scale, of details from FIG. 1.
Figure 3:
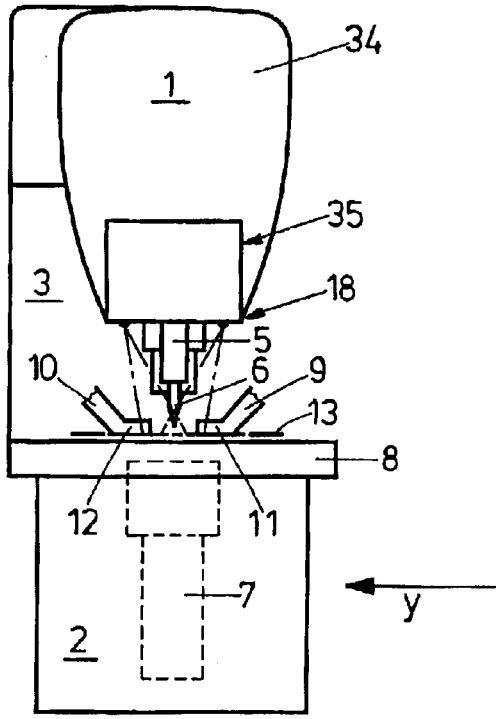
FIG. 3 is an elevation of the sewing machine in accordance with the arrow III of FIG. 1.

As seen in FIGS. 1 to 3, a buttonhole sewing machine is C-shaped, having an upper arm 1, a lower base plate 2 in the form of a casing and an approximately vertical standard 3 uniting the two. An arm shaft 4, which is drivable by a motor (not shown), conventionally lodges in the arm 1. Actuation of a vertically displaceable needle bar 5 with a needle 6 and a jogging drive therefor are conventionally derived from the arm shaft 4. Further, hook-bearing-7 actuation derives from the arm shaft 7, the hook bearing 7 being arranged in the base plate 2 and allocated to the needle 6.

Disposed on the base plate 2 is an x-y table 8 in the form of a cross slide movable in two horizontal coordinate directions i.e., the x direction and the y direction. The x-y table 8 is of conventional design as described for instance in U.S. Pat. No. 6,095,066. The x-y table 8 is operated by drive mechanisms (not shown), which may be electric positioning motors, preferably stepper motors or adjustable d.c. motors.

At least one work piece clamp is disposed on the x-y table 8. As a rule, provision is made for two work piece clamps 9, 10. The work piece clamps 9, 10 have clamping plates 11, 12, by means of which to press a work piece 13 on a bearing plate 14, regularly a two-piece plate, of the x-y table 8. By the side of the needle bar 5, provision is customarily made for a work piece cutting device 15 for buttonhole-cutting. It includes an anvil 16, which is mounted on the bottom of the arm 1 and has a cutting drive mechanism 17, and a knife (not shown), which is mounted on the x-y table 8. The cutting job usually takes place in such a way that the anvil 16 is moved downwards against the knife by the drive mechanism 17, cutting through the work piece 13 that is moved directly above the knife.

A lighting device 18 is provided on the bottom side of the arm 1, having an upwardly open casing 19 in the shape of a trough which comprises abutments 20 that bear against the bottom side 21 of the arm 21, these abutments 20 being equipped with through holes 22 for fasteners 23 that are screwed into the bottom side 21 of the arm 1. The casing 19 further comprises passages 24 and 25 for the needle bar 5 with the needle 6 and the anvil 16 of the cutting device 15.

In parallel to the front side wall 26 and the rear side wall 27 of the casing 19, provision is made for a line of side by side light emitting diodes 28 and 29 on either side of the needle-bar-5 passage 24 and, sectionally, also on either side of the cutting-device-15 passage 25. Light emitting diodes 30 are likewise provided behind the cutting-device-15 passage 25 seen in the x direction i.e., on the side of the passage 25 that is turned away from the passage 24. The light emitting diodes 28, 29, 30 are disposed in appropriate holes 31 in the bottom plate 32 of the casing 19; they are tilted sidewards from the vertical so that the entire work area 33 is illuminated and shadowless. As seen in particular from FIGS. 2 and 3, the work area 33 includes the stitch forming area where for instance a buttonhole is sewn, and the area where a buttonhole is cut by the cutting device 15. The work area 33 may extend beyond these areas for alignment of the work piece 13. In this case, it might be handy to have another lighting device 35 on the front 34 of the arm, which comprises a casing 36 with light emitting diodes 37 protruding from the bottom side and is otherwise designed in the same way as the lighting device 18. Such a lighting device 35 on the front 34 of the arm can be appropriate in particular when a presser foot (not shown) is provided, enfolding the needle 6 and casting a shadow.

Figure 5:
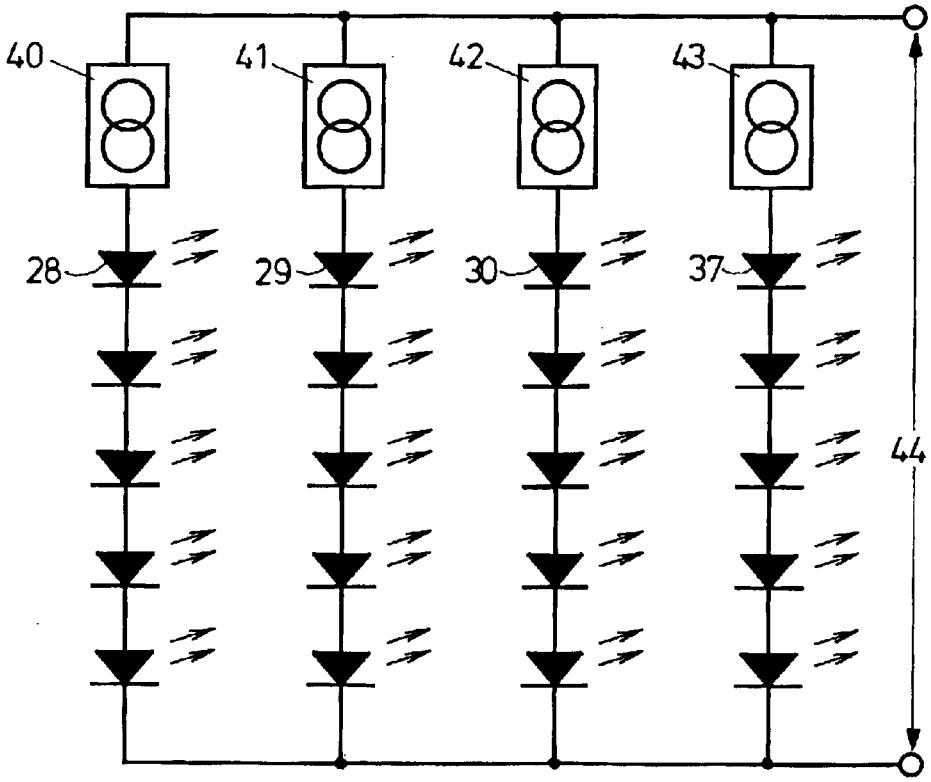
FIG. 5 is a connection diagram of the lighting equipment.
Figure 4:
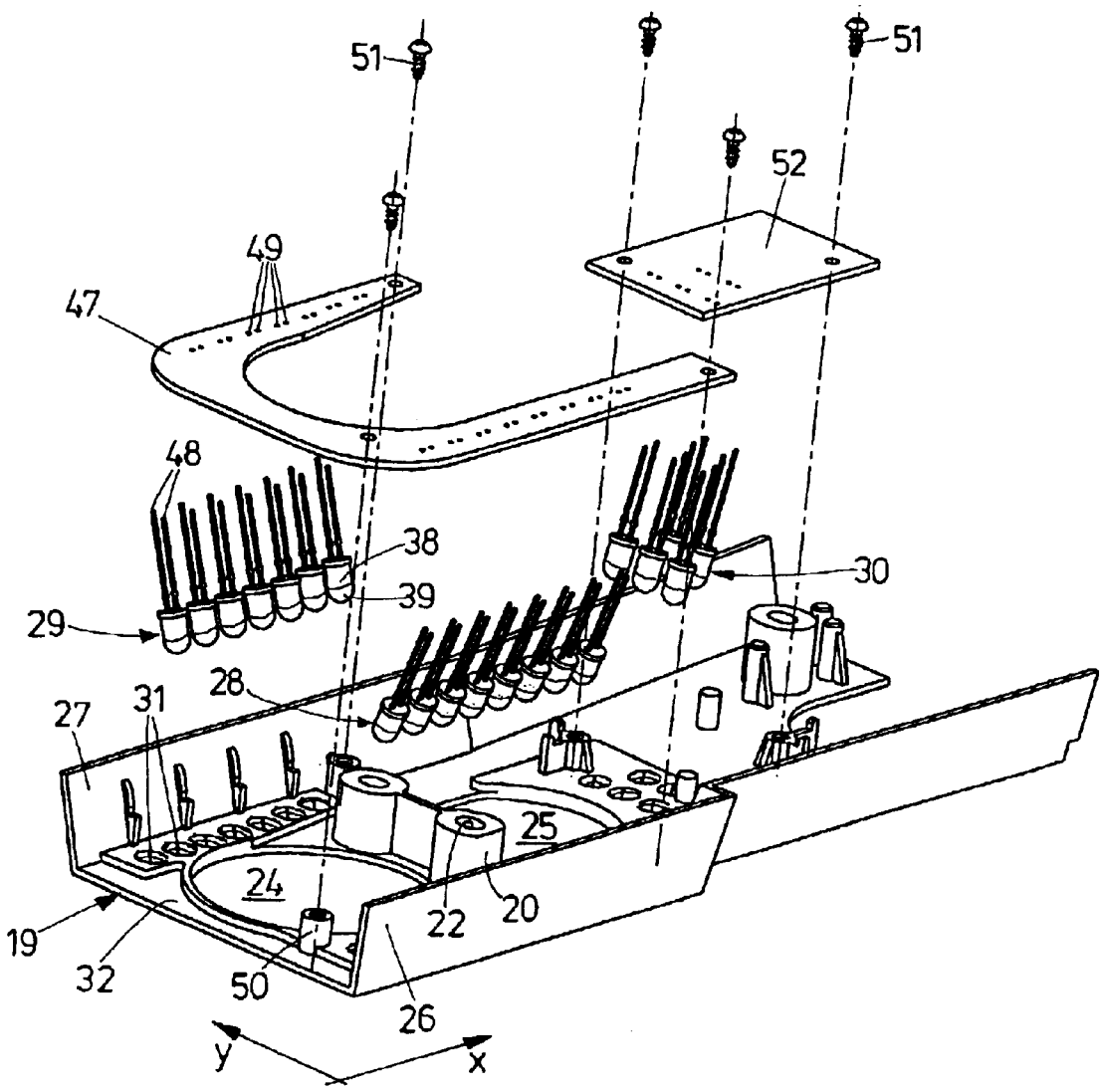
FIG. 4 is a perspective exploded view of the lighting equipment according to the invention.

Commercial light emitting diodes 28, 29, 30, 37, which are fundamentally identical with one another, have a lens 39 that is injected in their dome 38 of, as a rule, transparent plastic material, each emitting a cone of light of an identical cone angle a of approximately 20°. These familiar and commercial LEDs comprise a semiconductor solid body. There is a voltage drop per LED of approximately 3.5 V at an amperage of 20 mA. In this case, their light intensity/light strength is approximately 8000 millicandela. LEDs of this type do not follow Ohm's Law. The current increases approximately squared over the voltage. Therefore, these diodes are fed by current supplies with current limiters. These current limiters are commercial. FIG. 5 illustrates the circuitry of the light emitting diodes 28, 29, 30, 37. The grouped diodes 28 and 29 or 30 and 37, respectively, are connected in series and provided with a stabilized power supply 40 and 41 or 42 and 43, respectively. These stabilized power supplies are fed from the supply mains. They are disposed in a panel 45, with supply lines leading to the individual groups of light emitting diodes 28, 29, 30, 37, of which only a line 46 is shown.

For ease of assembly of the light emitting diodes 28, 29, 30, the diodes 28, 29 are held in a printed board 47 of the shape of a horseshoe, to which is connected the supply line 46; to this end, they are pushed by their feet 48 through corresponding holes 49 in the printed board 47 and soldered. This also defines their direction. The printed board 47 is placed on supports 50 of the casing 19 and fixed by screws 51. The light emitting diodes 30 are correspondingly fixed to another printed board 52, which is mounted in the casing 19 in the same way. The same also applies to the lighting device 35. The casing 19 may just as well be configured in such a way that the light emitting diodes 37 for arrangement on the front 34 of the arm 1, i.e. the lighting device 35, are integrated in the lighting device 18.

What is claimed is:

1. A lighting equipment on a sewing machine, comprising an arm with a bottom side and with a needle bar, and a work area which is allocated to the needle bar and substantially shadowlessly illuminated, wherein the needle bar is at least bilaterally surrounded by several light emitting diodes which are disposed in at least one lighting device comprising a casing in which several light emitting diodes are respectively grouped and held.

2. A lighting equipment according to claim 1, wherein the light emitting diodes are aligned and retained in the lighting device.

3. A lighting equipment according to claim 1, wherein the light emitting diodes are arranged on at least one printed board.

4. A lighting equipment according to claim 1, wherein the light emitting diodes have a given cone angle a of light emittance.

5. A lighting equipment according to claim 1, wherein the casing of at least one lighting device is mounted on the bottom side of the arm of the sewing machine.

6. A lighting equipment according to claim 1, wherein the casing comprises a passage for the noodle bar.

7. A lighting equipment according to claim 1, wherein the casing comprises a passage for a buttonhole cutting device.

8. A lighting equipment according to claim 1, wherein a group of light emitting diodes is allocated to the passage for the buttonhole cutting device.

9. A lighting equipment on a sewing machine, comprising an arm with a bottom side and with a needle bar; and a work area which is allocated to the needle bar and substantially shadowlessly illuminated, wherein the needle bar is at least bilaterally surrounded by several light emitting diodes which are disposed in at least one lighting device, the light emitting diodes being aligned and retained in the lighting device, the light emitting diodes also being arranged on at least one printed board.

10. A lighting equipment according to claim 9, wherein the at least one lighting device comprises a casing in which several light emitting diodes are respectively grouped and held.

11. A lighting equipment according to claim 9, wherein the light emitting diodes have a given cone angle a of light emittance.

12. A lighting equipment according to claim 10, wherein the casing of at least one lighting device is mounted on the bottom side of the arm of the sewing machine.

13. A lighting equipment according to claim 10, wherein the casing comprises a passage for the needle bar.

14. A lighting equipment according to claim 10, wherein the casing comprises a passage for a buttonhole cutting device.

15. A lighting equipment according to claim 14, wherein a group of light emitting diodes is allocated to the passage for the buttonhole cutting device.

16. A lighting equipment on a sewing machine, comprising an arm with a bottom side and with a needle bar; and a work area which is allocated to the needle bar and substantially shadowlessly illuminated, wherein the needle bar is at least bilaterally surrounded by several light emitting diodes which ire disposed in at least one lighting device.

17. A lighting equipment on a sewing machine, comprising an arm with a bottom side and with a needle bar; and a work area which is allocated to the needle bar and substantially shadowlessly illuminated, wherein the needle bar is at least bilaterally surrounded by several light emitting diodes which are disposed in at least one lighting device comprising a casing in which several light omitting diodes are respectively grouped and held, said casing comprising a passage for a buttonhole cutting device; a group of light emitting diodes allocated to the passage for the buttonhole cutting device.

18. A lighting equipment according to claim 17, wherein the light emitting diodes are aligned and retained in the lighting device.

19. A lighting equipment according to claim 17, wherein the light emitting diodes are arranged on at least one printed board.

20. A lighting equipment according to claim 17, wherein the light omitting diodes have a given cone angle a of light emittance.

21. A lighting equipment according to claim 17, wherein the casing of at least one lighting device is mounted on the bottom side of the arm of the sewing machine.

22. A lighting equipment according to claim 17 wherein the casing comprises a passage for the needle bar.

23. A light arrangement for a sewing machine, the device comprising:

a casing with a mount to be mounted to a bottom of an arm of the sewing machine, said casing being arranged around a plurality of sides of a needle bar of the arm of the sewing machine;

a plurality of light emitting diodes mounted in said casing and arranged in said casing around said plurality of sides of the needle bar to substantially evenly illuminate a work area around the needle bar.

* * * * *